US006619215B1

(12) United States Patent
Lin

(10) Patent No.: US 6,619,215 B1
(45) Date of Patent: Sep. 16, 2003

(54) INCINERATOR WITH A HEAT-INSULATING SHIELD

(76) Inventor: Dai-You Lin, No. 1069, Chung-Cheng Rd., Wu-Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/131,936

(22) Filed: Apr. 24, 2002

(51) Int. Cl.[7] ..... F23M 9/00; F23N 5/24; F23K 3/00; F26B 19/00

(52) U.S. Cl. ..... 110/233; 110/193; 110/322; 110/308; 110/101 CA; 110/101 C; 110/186; 34/446; 34/575; 34/90

(58) Field of Search ..... 110/308, 208, 110/210, 233, 193, 235, 297, 302, 303, 304, 101 CA, 267, 101 R, 101 C, 101 CF, 185, 186, 190; 34/427, 446, 524, 573, 575, 90

(56) References Cited

U.S. PATENT DOCUMENTS 2,069,584 A * 2/1937 Lorton ..... 110/13
3,859,174 A * 1/1975 Taylor ..... 203/10
3,958,920 A * 5/1976 Anderson ..... 432/23
4,047,490 A * 9/1977 Galluzzo ..... 110/56
4,060,042 A * 11/1977 Baraldi et al. ..... 110/14
4,311,103 A * 1/1982 Hirose ..... 110/238
4,315,468 A * 2/1982 Tyer et al. ..... 110/101 CF
4,517,902 A * 5/1985 Christian ..... 110/190
5,315,938 A * 5/1994 Freller ..... 110/233
5,341,637 A * 8/1994 Hamrick ..... 60/39.464
5,799,590 A * 9/1998 Noguchi ..... 110/216

* cited by examiner

*Primary Examiner*—Ira Lazarus
*Assistant Examiner*—K. B. Rinehart
(74) *Attorney, Agent, or Firm*—Sheridan Ross PC

(57) ABSTRACT

An incinerator includes a furnace, a heat-insulating shield, an air conduit, an air blower, and a dryer. The heat-insulating shield has a top wall, a vertically extending peripheral wall that extends downwardly from the top wall and that surrounds and that is spaced apart from the furnace by a gap, and an open bottom end. The peripheral wall of the heat-insulating shield has an air outlet that is disposed adjacent to the top wall and that is in fluid communication with the gap. Atmospheric air is introduced via the open bottom end through the gap and the air conduit and into the dryer.

3 Claims, 7 Drawing Sheets

INCINERATOR WITH A HEAT-INSULATING SHIELD

BACKGROUND OF THE INVENTION

This invention relates to an incinerator, more particularly to an incinerator with a heat-insulating shield that surrounds a furnace for heating air in a gap therebetween.

SUMMARY OF THE INVENTION

The object of the present invention is to provide an incinerator with a heat-insulating shield that surrounds a furnace for heating air in a gap there between. The heated air is then used for drying crops in a dryer.

According to the present invention, an incinerator comprises: a furnace adapted to incinerate solid waste and including a vertically extending peripheral wall having a bottom section defining a main combustion chamber, an intermediate section extending upwardly from said bottom section to define an auxiliary combustion chamber, and a top section extending upwardly from said intermediate section and formed with an effluent outlet for exit of a combustion gas generated in said main and auxiliary combustion chambers; a cyclone separator connected to said effluent outlet for receiving the combustion gas from said furnace; a heat-insulating shield having a top wall, a vertically extending peripheral wall that extends downwardly from said top wall and that surrounds and that is spaced apart from said peripheral wall of said furnace by a gap, and an open bottom end, said top section of said peripheral wall of said furnace extending outwardly through said top wall, said effluent outlet being disposed outwardly of said heat-insulating shield, said peripheral wall of said heat-insulating shield having an air outlet that is disposed adjacent to said top wall and that is in fluid communication with said gap; an air conduit connected to said air outlet and in fluid communication with said gap via said air outlet; a dryer connected to and in fluid communication with said air conduit; and an air blower disposed downstream of said air outlet for introducing atmospheric air via said open bottom end through said gap and said air conduit and into said dryer such that the introduced atmospheric air is heated in said gap by virtue of heat flow from said peripheral wall of said furnace into said gap.

BRIEF DESCRIPTION OF THE DRAWINGS

In drawings which illustrate an embodiment of the invention.

DETAILED DESCRIPTION OF THE PREFERRED EMBODIMENT

Figure 1:
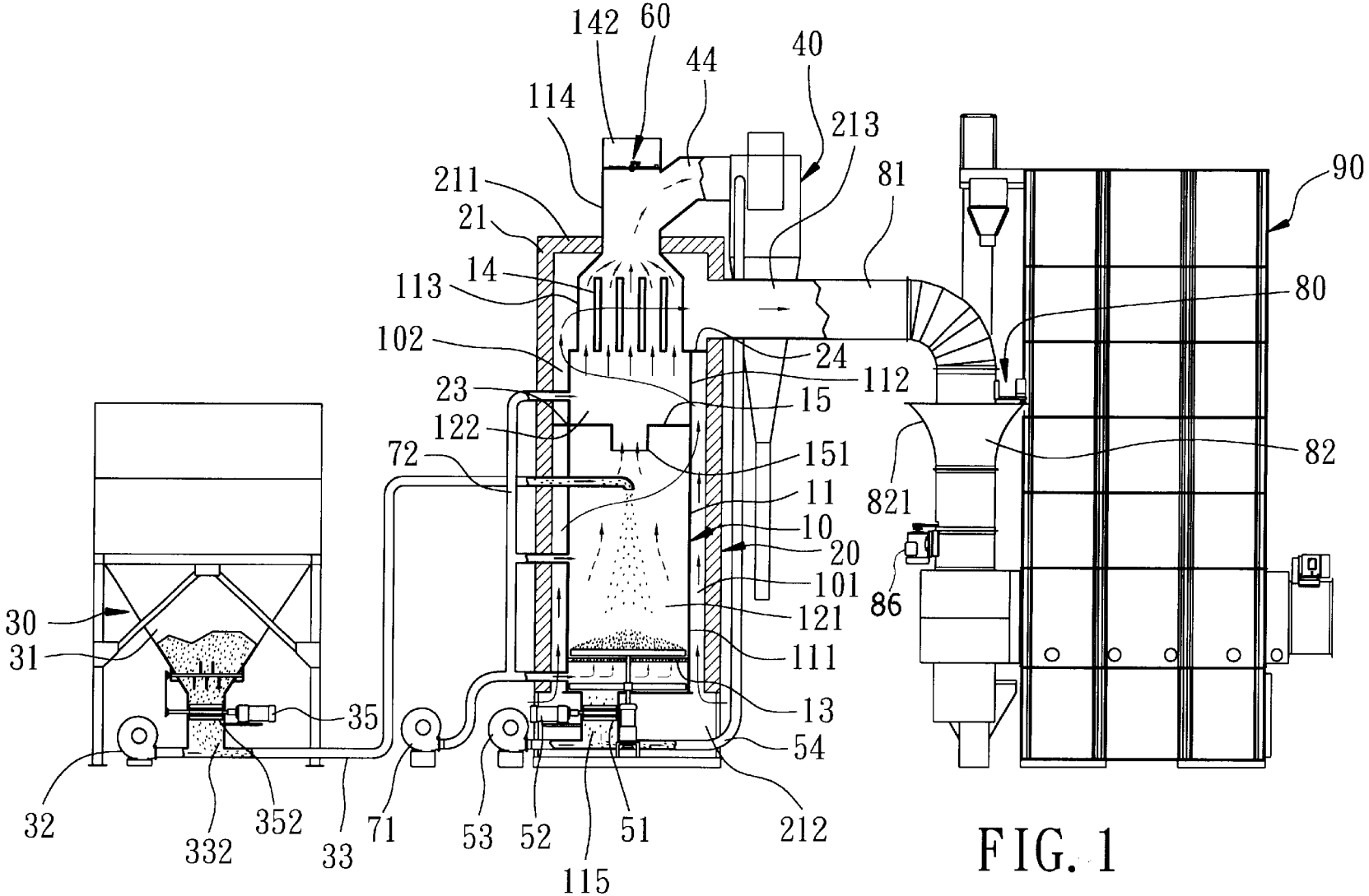
FIG. 1 is a schematic view of an incinerator embodying this invention.

FIGS. 1 to 7 illustrate a preferred embodiment of an incinerator of this invention for combustion of solid waste, such as hull or shell waste of agricultural crops.

The incinerator includes: a furnace 10 having a vertically extending peripheral wall 11 with a bottom section 111 defining a main combustion chamber 121, an intermediate section 112 extending upwardly from the bottom section 111 to define an auxiliary combustion chamber 122, a cooling section 113 extending upwardly from the intermediate section 112, and a top section 114 extending upwardly from the cooling section 113 and formed with an effluent outlet 44 for exit of a combustion gas generated in the main and auxiliary combustion chambers 121, 122, a partition plate 15 being disposed in the furnace 10 to separate the main and auxiliary combustion chambers 121, 122 and being formed with a channel 151 that is in fluid communication with the main and auxiliary combustion chambers 121, 122; a cooler 14 disposed in the cooling section 113 for cooling the combustion gas passing there through; a cyclone separator 40 connected to the effluent outlet 44 for receiving the combustion gas from the furnace 10; a heat-insulating shield 20 having a top wall 211, a vertically extending peripheral wall 21 that extends downwardly from the top wall 211 and that surrounds and that is spaced apart from the peripheral wall 11 of the furnace 10 by a gap 101, and an open bottom end 212, the top section 114 of the peripheral wall 11 of the furnace 10 extending outwardly through the top wall 211, the effluent outlet 44 being disposed outwardly of the heat-insulating shield 20, the peripheral wall 21 of the heat-insulating shield 20 having an air outlet 213 that is disposed adjacent to the top wall 211 and that is in fluid communication with the gap 101; an air conduit connected to the air outlet 213 and in fluid communication with the gap 101 via the air outlet 213; a dryer 90 connected to and in fluid communication with the air conduit; and an air blower 86 disposed downstream of the air outlet 213 and is mounted on said air conduit for introducing atmospheric air via the open bottom end 212 through the gap 101 and the air conduit 213 and into the dryer 90 such that the introduced atmospheric air is heated in the gap 101 by virtue of heat flow from the peripheral wall 11 of the furnace 10 into the gap 101.

The heat-insulating shield 20 is formed with a plurality of baffles 23, 24 interconnecting the peripheral wall 21 of the heat-insulating shield 20 and the peripheral wall 11 of the furnace 10 so as to form a tortuous channel 102 there among for passage of the hot air flowing in the gap 101.

Figure 2:
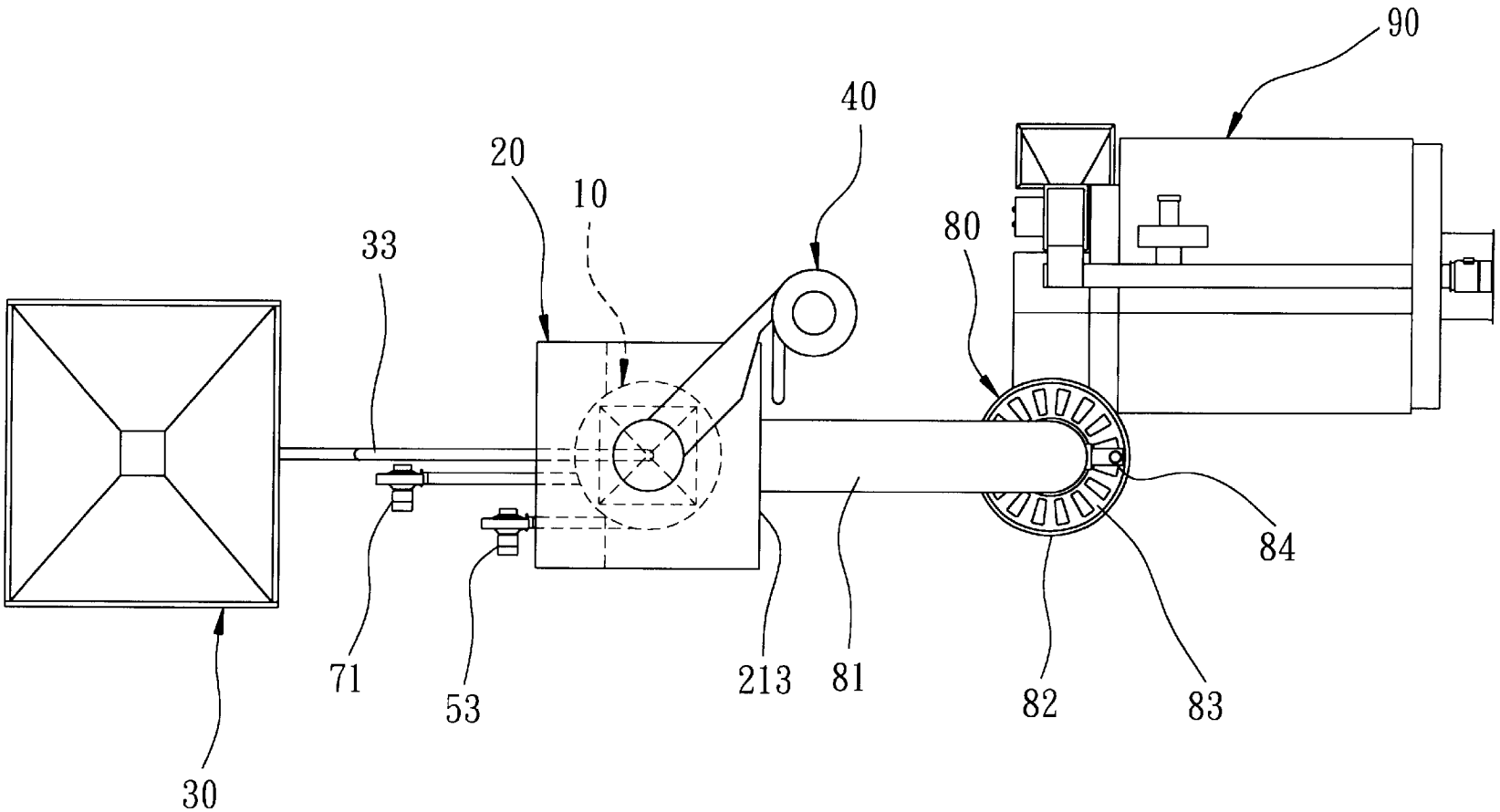
FIG. 2 is a schematic top view of the incinerator of FIG. 1.
Figure 3:
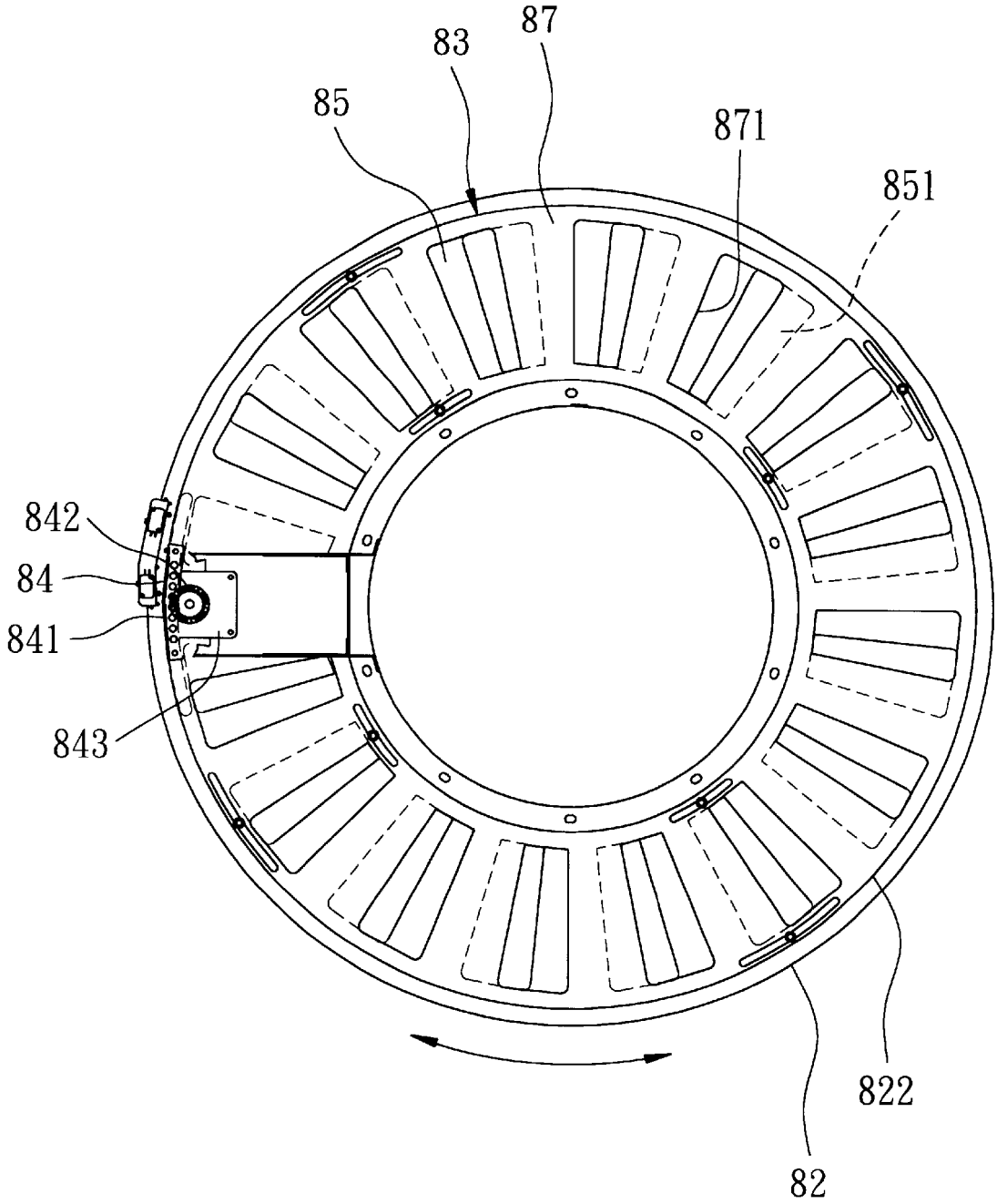
FIG. 3 is a schematic top view to illustrate how an air-flow controller of the incinerator of FIG. 1 is operated to open a control valve.
Figure 4:
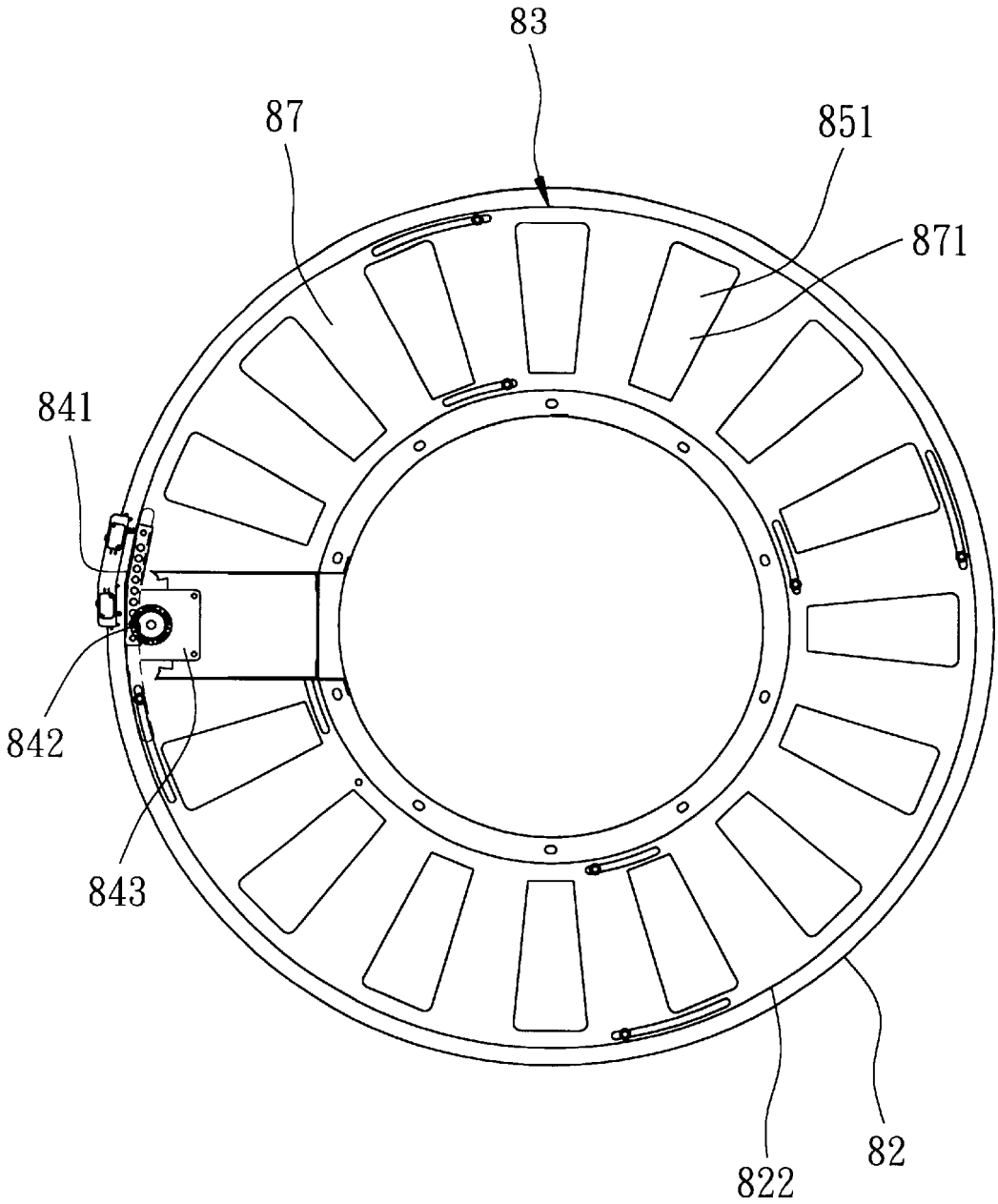
FIG. 4 is a schematic top view to illustrate how the air flow controller of FIG. 5 is operated to close the control valve.

Referring to FIGS. 2 to 4, the air conduit has first and second sections 81, 82. An air-flow controller 80 is disposed between the first and second sections 81, 82, and includes a control valve 83, a pinion-and-rack unit 84, and a driving unit 843 mounted on the air conduit. The first section 81 has one end connected to the air outlet 213, and an opposite end connected to the second section 82. The second section 82 has an enlarged end 821 which has an inner wall 822, which receives the opposite end of the first section 81, and which converges in a direction toward an opposite end of the second section 82 opposite to the enlarged end 821. The control valve 83 is disposed in the enlarged end 821 of the second section 82, and includes a lower disc 85 that extends radially and inwardly from the inner wall 822 around the opposite end of the first section 81, and an upper disc 87 that is rotatable stacked on the lower disc 85. The upper and lower discs 87, 85 are formed with angularly spaced apart upper and lower slots 871, 851 around the opposite end of the first section 81. The pinion-and-rack unit 84 includes a rack 841 secured to the upper disc 87, and a pinion 842 coupled to the driving unit 843 and meshing with the rake 841 so as to permit rotation of the upper disc 87 relative to the lower disc 85 between an open position (see FIGS. 3 and 4), in which, the upper and lower slots 871, 851 are overlapped, thereby permitting atmospheric air to be introduced into the enlarged end 821 of the second section 82 via the upper and lower slots 871, 851 upon actuation of the air blower 86, and a closed position, in which, the upper and lower slots 871, 851 are offset from each other and are closed by the lower and upper discs 85, 87, respectively, thereby preventing atmospheric air from flowing into the enlarged end 821 of the second section 82 via the upper and lower slots 871, 851.

Figure 5:
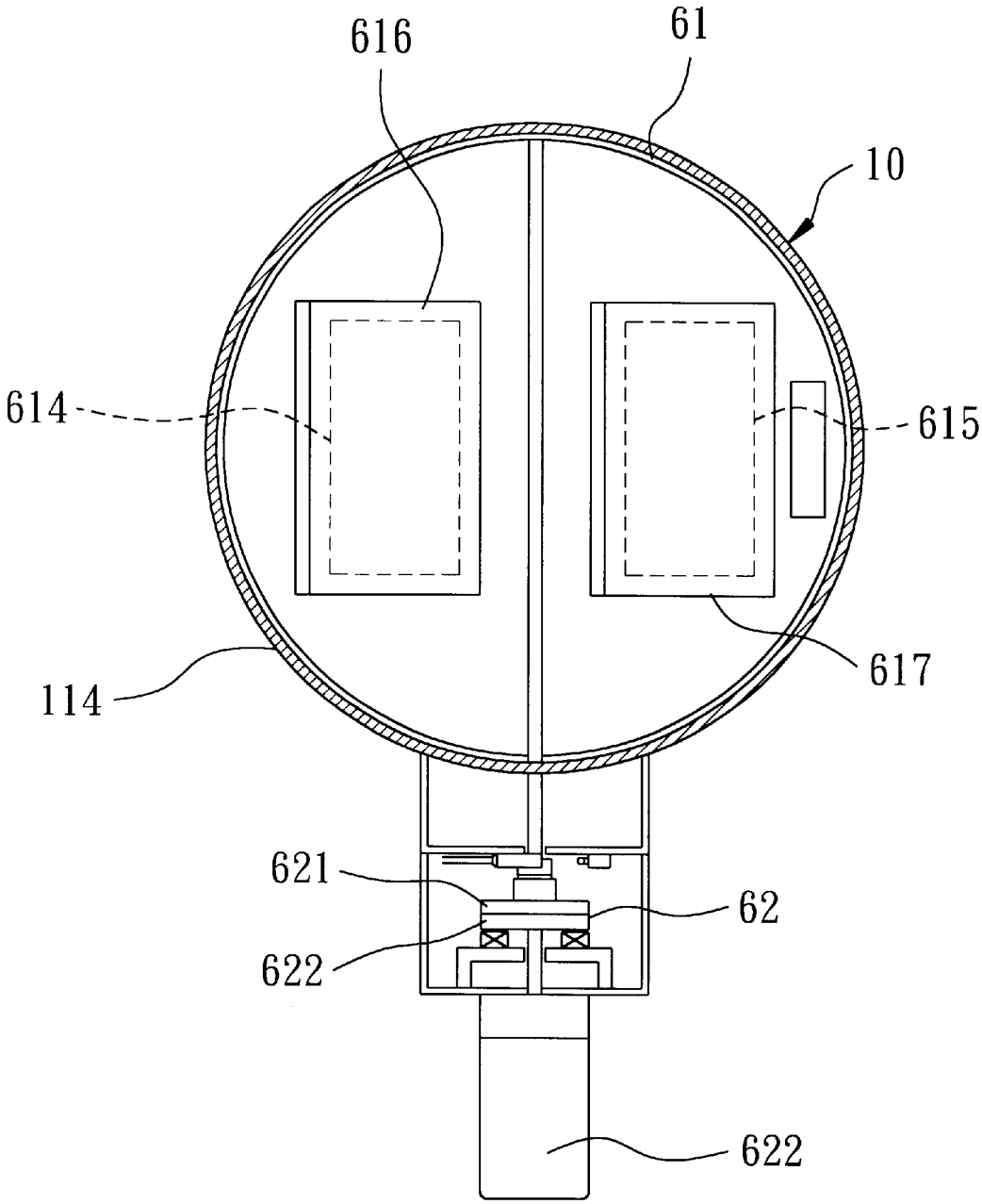
FIG. 5 is a partly sectional schematic top view to illustrate how a safety valve of the incinerator of FIG. 1 is operated in a closed position when the incinerator is in a normal condition.
Figure 6:
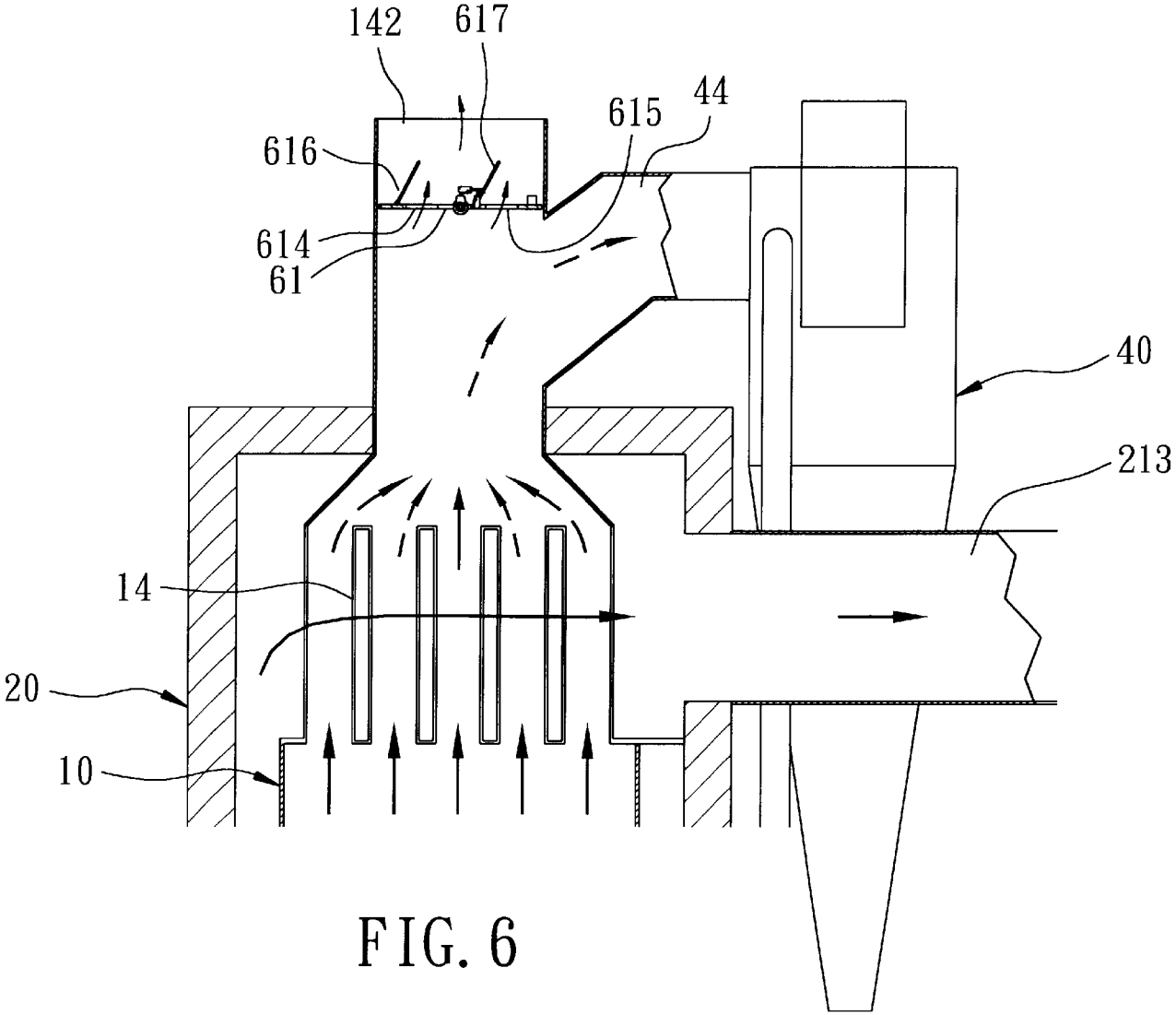
FIG. 6 is a partly sectional schematic side view to illustrate how the safety valve of FIG. 5 is opened via two covers in the safety valve when the incinerator encounters an emergency.
Figure 7:
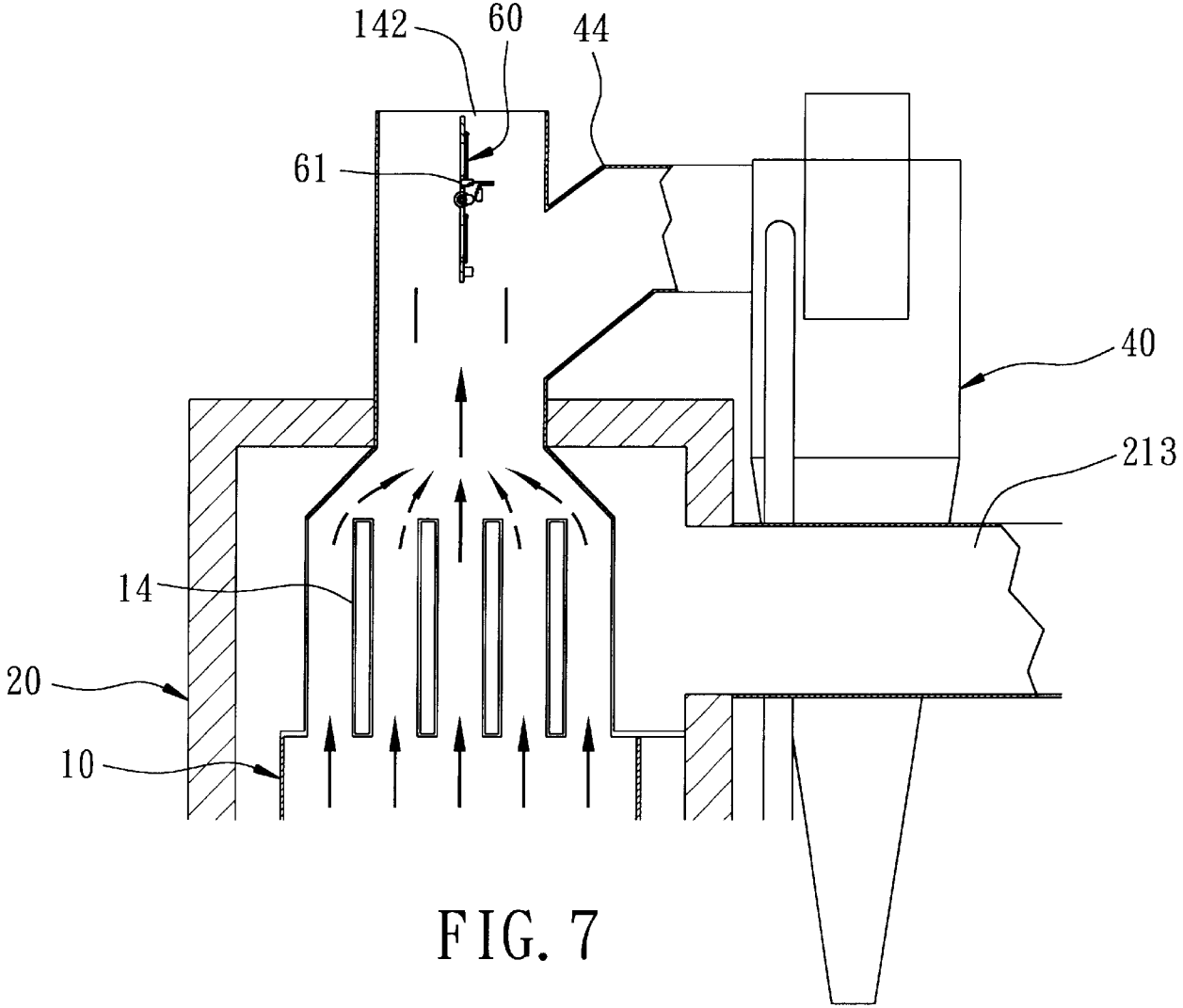
FIG. 7 is a partly sectional schematic side view to illustrate how the safety valve of FIG. 5 is fully opened when the incinerator is in an abnormal condition.

Referring to FIGS. 5 to 7, in combination with FIG. 1, the top section 114 of the peripheral wall 11 of the furnace 10 is further formed with a safety outlet 142. A safety valve 60 is disposed in the safety outlet 142, and includes a valve seat 61 that is rotatable about an axis relative to the safety outlet 142 between a closed position (see FIG. 5), in which, the safety outlet 142 is closed by the valve seat 61, and an open position (see FIG. 7), in which, the safety outlet 142 is opened. A driving member 622 is mounted on an exterior of the furnace 10, and is releasably connected to the valve seat 61 for driving the valve seat 61 to rotate about the axis-when actuated. An electomagnetic control unit 62 is coupled to the valve seat 61 and the driving member 622, and is actuated when the furnace 10 is operated in a normal condition so as to magnetically interconnect the driving member 622 and the valve seat 61, which, in turn, permits the valve seat 61 to be disposed at the closed position, and that is deactivated when the furnace 10 is operated in an abnormal condition, in which, the driving member 622 is disconnected from the valve seat 61, thereby permitting free rotation of the valve seat 61 about the axis from the closed position to the open position (see FIG. 7). The electromagnetic control unit 62 has a pair of magnetically operated first and second connecting plates 621, 622 which are respectively connected to the valve seat 61 and the driving member 622, which are magnetically connected to each other when the electromagnetic control unit 62 is magnetically actuated, and which are disconnected from each other when the electromagnetic control unit 62 is deactivated.

Referring to FIGS. 5 and 6, the safety valve 60 is formed with a pair of emergency openings 614, 615 and a pair of covers 616, 617 which cover the emergency openings 614, 615 when the furnace 10 is operated in the normal condition, and which are opened when the furnace 10 encounters an emergency, as when the pressure inside the furnace 10 is abruptly increased.

A feeding device 30 is connected to the furnace 10 for feeding the solid waste into the furnace 10, and includes a hopper 31 with a bottom outlet 332, a rotary wheel 352 driven by a motor 35 and rotatable disposed in the hopper 31 for feeding a constant amount of the solid waste to the bottom outlet 332, a pipe 33 interconnecting the bottom outlet 332 and the furnace 10, and a blower 32 connected to the bottom outlet 332 for delivering the solid waste into the furnace 10 via the pipe 33.

A main blower 71 is connected to the furnace 10 via an air pipe 72 for delivering air into the furnace 10.

A perforated supporting plate 13 is disposed in the bottom section 111 of the furnace 10 for supporting the solid waste. Ash falling from the supporting plate 13 is transferred to a bottom exit 115 of the furnace 10 via a second rotary wheel 51 driven by a motor 52. Another blower 53 is connected to the bottom exit 115 for delivering the falling ash into the cyclone separator 40 via a pipe 54.

With the invention thus explained, it is apparent that various modifications and variations can be made without departing from the spirit of the present invention. It is therefore intended that the invention be limited only as recited in the appended claims.

I claim:

1. An incinerator comprising:

a furnace adapted to incinerate solid waste and including a vertically extending peripheral wall having a bottom section defining a main combustion chamber, an intermediate section extending upwardly from said bottom section to define an auxiliary combustion chamber, and a top section extending upwardly from said intermediate section and formed with an effluent outlet for exit of a combustion gas generated in said main and auxiliary combustion chambers;

a cyclone separator connected to said effluent outlet for receiving the combustion gas from said furnace;

a heat-insulating shield having a top wall, a vertically extending peripheral wall that extends downwardly from said top wall and that surrounds and that is spaced apart from said peripheral wall of said furnace by a gap, and an open bottom end, said top section of said peripheral wall of said furnace extending outwardly through said top wall, said effluent outlet being disposed outwardly of said heat-insulating shield, said peripheral wall of said heat-insulating shield having an air outlet that is disposed adjacent to said top wall and that is in fluid communication with said gap;

an air conduit connected to said air outlet and in fluid communication with said gap via said air outlet;

a dryer connected to and in fluid communication with said air conduit; and an air blower disposed downstream of said air outlet for introducing atmospheric air via said open bottom end through said gap and said air conduit and into said dryer such that the introduced atmospheric air is heated in said gap by virtue of heat flow from said peripheral wall of said furnace into said gap.

2. The incinerator of claim 1, wherein said heat-insulating shield is formed with a plurality of baffles interconnecting said peripheral wall of said heat-insulating shield and said peripheral wall of said furnace so as to form a tortuous channel there among for passage of the hot air flowing in said gap.

3. The incinerator of claim 1, wherein said top section of said peripheral wall of said furnace is further formed with a safety outlet, said incinerator further comprising a safety valve disposed in said safety outlet and including a valve seat that is rotatable relative to said safety outlet about an axis between a closed position, in which, said safety outlet is closed by said valve seat, and an open position, in which, said safety outlet is opened; a driving member mounted on an exterior of said furnace and releasably connected to said valve seat for driving said valve seat to rotate about said axis when actuated; and an electromagnetic control unit that is actuated when said furnace is operated in a normal condition so as to magnetically interconnect said driving member and said valve seat, which, in turn, permits said valve seat to be disposed at said closed position, and that is deactivated when said furnace is operated in an abnormal condition, in which, said driving member is disconnected from said valve seat, thereby permitting free rotation of said valve seat about said axis from said closed position to said open position.

* * * * *